US010047468B2

(12) United States Patent
Plata Amarillas et al.

(10) Patent No.: US 10,047,468 B2
(45) Date of Patent: Aug. 14, 2018

(54) INFUSOR WITH FLOATING SYSTEM INTERFACE WASHING MACHINE

(71) Applicant: MABE, S.A. DE C.V., Santiago de Queretaro, Queretaro (MX)

(72) Inventors: Santiago Alonso Plata Amarillas, Queretaro (MX); Ramon Merino Cervantes, Queretaro (MX); Omar Loza Guerrero, Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 395 days.

(21) Appl. No.: 14/560,394

(22) Filed: Dec. 4, 2014

(65) Prior Publication Data

US 2015/0159309 A1 Jun. 11, 2015

(30) Foreign Application Priority Data

Dec. 6, 2013 (MX) ..... MX/a/2013/014369

(51) Int. Cl.

| | |
|---|---|
| ***D06F 17/10*** | (2006.01) |
| ***D06F 17/06*** | (2006.01) |
| ***D06F 17/08*** | (2006.01) |
| ***D06F 37/40*** | (2006.01) |

(52) U.S. Cl.

CPC ..... *D06F 17/10* (2013.01); *D06F 17/06* (2013.01); *D06F 17/08* (2013.01); *D06F 37/40* (2013.01)

(58) Field of Classification Search

CPC ..... D06F 17/06; D06F 17/08; D06F 17/10; D06F 37/40

See application file for complete search history.

(56) References Cited

U.S. PATENT DOCUMENTS

| | | | | |
|---|---|---|---|---|
| 4,494,390 | A * | 1/1985 | Hayashi | D06F 17/10 68/133 |
| 4,779,431 | A | 10/1988 | Burk et al. | |
| 5,586,455 | A | 12/1996 | Imai et al. | |
| 5,651,277 | A | 7/1997 | Richardson | |
| 6,634,193 | B2 | 10/2003 | Lee et al. | |
| 6,951,121 | B2 | 10/2005 | Lee et al. | |
| 8,387,422 | B2 * | 3/2013 | Hettinger | D06F 17/06 68/134 |
| 8,833,111 | B2 | 9/2014 | Dominguez et al. | |
| 2007/0044520 | A1 * | 3/2007 | Kopyrin | D06F 37/14 68/131 |
| 2007/0101772 | A1 * | 5/2007 | Duncan | D06F 17/10 68/3 R |
| 2007/0130999 | A1 * | 6/2007 | Dominguez | D06F 37/24 68/12.24 |

(Continued)

FOREIGN PATENT DOCUMENTS

| | | |
|---|---|---|
| MX | 275317 | 4/2010 |

*Primary Examiner* — Joseph L Perrin

(74) *Attorney, Agent, or Firm* — Terry M. Sanks, Esq.; Beusse Wolter Sanks & Maire, PLLC

(57) ABSTRACT

An infuser with an integral coupler for use in automatic washing machines is described, wherein thanks to the outer geometry thereof, that is to say, thanks to the combination of the curvature of the blades on its front face and the concavity on its side faces, there is no need for the water to completely cover the textile clothes load, because it is in constant motion due to the generation of a strong stream going from the bottom to the top, resulting in a homogeneity in cleansing with a much less amount of water.

5 Claims, 5 Drawing Sheets

(56) References Cited

U.S. PATENT DOCUMENTS

| | | | | |
|---|---|---|---|---|
| 2011/0099726 | A1* | 5/2011 | Plata Amarillas | D06L 1/20 8/137 |
| 2013/0340180 | A1* | 12/2013 | Shu | D06F 35/006 8/137 |
| 2014/0190217 | A1* | 7/2014 | Cole | D06F 21/06 68/134 |
| 2014/0352364 | A1* | 12/2014 | Martinez Villarreal | D06F 39/022 68/17 R |
| 2015/0000352 | A1* | 1/2015 | Carr | D06F 17/10 68/133 |
| 2015/0033803 | A1* | 2/2015 | Carr | D06F 13/00 68/133 |

* cited by examiner

INFUSOR WITH FLOATING SYSTEM INTERFACE WASHING MACHINE

CROSS-REFERENCE TO RELATED APPLICATIONS

This application claims priority to Mexican Patent Application No. MX/a/2013/014369 filed Dec. 6, 2013, and incorporated herein by reference in its entirety.

FIELD OF THE INVENTION

The present invention relates to principles and techniques used in the Home Appliances Industry for the design and manufacture of home appliances and its parts allowing to perform some of the routine home duties more easily, and in a safety and reliable manner, and more particularly, it relates to an infuser with an integral coupler for automatic washing machines, which use a clutch system of the float type.

BACKGROUND OF THE INVENTION

Today, in the Home Appliances Industry the consumer's demands for better household appliances are continuously increasing and more stringent, requiring more modern and appealing designs, which are at the forefront of technology and have an added value, allowing to perform some of the routine home duties in an easier, safety and reliable manner, providing comfort and speed when performing such tasks.

Among the home appliances, and more particularly white goods or appliances, the washing machine is one of those appliances which is essential, being useful in washing garments, bed clothing and linen in general, saving time and effort, but especially, what is sought today is something more environmentally friendly that saves water and uses less detergent and power.

Currently, there are lots of types of washing machines, such as industrial, domestic, vertical (top loading), horizontal (front loading), automatic, semi-automatic, manual washing machines, washing machines with drum, propeller, agitator, rollers, centrifugation, and the like.

Depending on the type of washing machine, different washing systems exist, namely:

i) European or front loading system, which uses a drum that rotates first in one direction with clothes tumbling inside the drum in such a manner that when they reach a higher point, then they drop onto the water surface. Then there is a small pause which allows for the detergent to act and then resumes the operation but in the opposite direction. This continued action of clothes dropping onto the water is what ultimately removes dirt. The drawback of this system is that it requires longer washing cycles, and hence more power consumption.

ii) American or top loading system, it uses a central agitator with blades that move clothes inside the drum, with the agitator direction periodically reversed, wherein said agitator besides "agitating" the water, also provides friction to clothes in such a way that removes dirt. This system results in a premature deterioration of clothes, because the damage to clothes is higher than in other systems; also consuming higher amounts of water.

iii) Oriental or turbine system, this uses a turbine or impeller, which is simply a disc located on the bottom of the basket having small blades, that when rotating in different directions and at a high speed generates turbulence in water, which twists the clothes, moving them up and down, scrubbing them together against the blades and the basket walls.

This washing system is very aggressive with clothes due to the friction which this washing system is based on in order to remove dirt, further requiring a high consumption of water.

iv) Washing system with an infuser, this is the newest system, which uses an infuser generating water streams that remove dirt from clothes without requiring friction between clothes. Washing machine with infusion technology push water through the sides of the basket towards the center, while the infuser pushes water to the walls of the basket, where this actions combined result in water pressure pushing the clothes across the washing machine thus cleaning them. The infuser operates because the water pressure causes the clothes to scrub together and move across the water to remove dirt particles with much less water compared to other systems.

Besides, it is well known that conventional washing machines have in common the excessive consumption of water, in some cases consuming as much as 120 liters per each single load, where water is not efficiently used at all and wasting great amounts of this valuable fluid. Also, they make use of propellers or agitators that due to its shape require large amounts of water inside the drum in order to carry out the washing action. Therefore, by using a higher amount of water conventional washing machines achieve a uniform washing, because the water level always is higher than the load to be washed, so that homogeneity in washing is achieved in a somewhat rough manner and generating an excess in the level of water used which ultimately is wasted.

According to the above, for designing washing machines and its parts, it is important to consider several factors, such as the capability to correctly transmit the power from the motor to the drive shaft, wherein the use of an appropriate clutch mechanism becomes necessary; the use of a mechanism providing the motion to the clothes for a more efficient washing; savings in power consumption, but mainly in water which is a vital resource; among other factor to take into consideration.

In washing machines two kind of clutches are used for the rotary motion transmitting system, one of them is of the float type and the other one is the one which uses a thermo-actuator. However, both systems are designed for washing systems that uses an agitator.

As can be seen from the above, the friendliest washing system for textile clothes is the washing system that uses an infuser.

No document was found in the state of the art describing an infuser with an integral coupler usable in automatic washing machines.

Nevertheless, in order to establish the state of the art for the inventions as claimed in the present specification, reference will be made to documents describing float-type clutch systems and an agitator as a mechanism to impart motion to clothes. Such is the case with the Mexican Patent No. 275,317, which refers to a floating clutch for two concentric shafts, wherein by means of a movable body, power can be transmitted from one shaft to the other through gears that engage and disengage vertically depending on the presence of certain fluid, thus transmitting torque from the inner shaft to the coupler, and from this in turn to the movable body, and in turn to the fixed clutch, which transmits said torque to the outer shaft when it is in the engaged position. However, such system has the disadvantage of being used only in washing machines with agitators.

In another instance, Mexican Patent No. 286,316 describes a clutch for washing machines to rotate or oscillate an agitator or propeller, and selectively rotate a basket, comprising a support member having a first holder, a second holder and end members, a thermo-actuator with a piston, a fork having a lever attached to arms, ends and a protrusion, wherein the ends and the protrusion are arranged on the arm; a first spring connected between the support member and the shifting fork, a cover shaft and a shaft configured so as to rotate, a movable clutch containing an top wall, a groove, an inner part and a bottom wall, wherein said ends abut against the groove and the top wall, wherein the bottom wall comprises a plurality of alternating teeth and grooves, and wherein the movable clutch couples to the cover-shaft through its inner portion, a pulley clutch having a plurality of alternating teeth and grooves, and an inner portion, wherein the pulley-clutch is coupled to a shaft through the inner portion of said pulley-clutch, wherein the movable clutch engages with the pulley-clutch by a motion of said arms, the ends, the protrusion and the movable clutch.

U.S. Pat. No. 5,586,455 refers to an automatic washing machine, which includes a float-type clutch having external gear teeth. The float-type clutch is located around a shaft which is driven by an electric motor and to which an agitator is secured. The float-type clutch couples to the shaft to an inner rotatable tub when its external gear teeth are engaged with internal gear teeth at the inner tub side in a dehydration step. The float-type clutch moves upwardly in order to float when water is supplied into the inner tub in a washing step. The external gear teeth of the float-type clutch are disengaged from the internal gears so that the shaft is decoupled from the inner tub. The washing machine further includes a floater to restrict rotation which moves upwardly in order to float in the washing step to couple the inner tub to an outer stationary tub and which decouples the inner tub from the outer tub in the dehydration step. A device delivers a position signal indicative of the position of the float-type clutch which is vertically movable. Based on the position signal, a control device controls the drive motor. The drive motor is of an outer rotor type and a motor control circuit is disposed in its stator.

U.S. Pat. No. 4,779,431 discloses an agitator that produces sinusoidal motion inside the washing machine, which by means of the agitator having flexible sheaths provides condolatory motion, wherein washing is carried out by friction of the load itself. Also, said cited document require large amounts of water to achieve an optimum performance, because the agitator design requires more water to operate efficiently.

U.S. Pat. No. 5,651,277 describes an automatic washing machine, which includes an elongated shaft mounted to a motor for rotation about the longitudinal axis of the shaft, a fabric basket is rotatable mounted to the shaft and an agitator is attached to the shaft above the fabric basket. A clutch is positioned between the agitator and the fabric basket and is movable from a disengaged position wherein the agitator rotates independently of the basket to an engaged position wherein the agitator rotates in unison with the basket. The clutch is movable from its engaged position to its disengaged position in response to the rise of washing fluid within the washing basket.

U.S. Pat. No. 6,634,193 refers to a washing machine having a floating clutch for performing the conversion of a cleansing step and a dehydrating step. This floating clutch can be actuated only by using buoyancy and gravity to be generated during the feeding/draining of water without a separate driving part. Accordingly, the construction of the clutch part can be simplified, and consequently the cost of manufacturing the washing machine can be reduced.

U.S. patent No. discloses a washing machine with a floating clutch wherein a float is connected to the rotational force of a motor through a centrifuge drying shaft or disconnects the rotational force from the drying rotary shaft, since it is moved upwards or downwards according to the supply or drain of washing water, thus allowing to carry out a washing operation or a dehydration operation, while an air layer is formed so as to prevent the washing water to reach the gears included within the floating clutch.

U.S. Pat. No. 6,951,121 relates to a washing machine with direct drive impeller such that it is directly connected to a motor. In this washing machine, the conversion of cleansing/dehydrating processes can be achieved without any problem by a floating clutch capable of being actuated by buoyancy and gravity to be induced during the supply/drain of water.

According to the above, it can be appreciated that there is a great variety of washing machines in the state of the art, some of which are discussed herein. However, all of them include an agitator or impeller to provide motion to clothes and thus remove dirt particles. Nevertheless, as already discussed above, the washing system using an agitator or impeller require large amounts of water, besides the premature damage imparted to the textile clothes.

BRIEF DESCRIPTION OF THE INVENTION

It has been found surprisingly that when an infuser is provided with blades whose curvature on its front faces in combination with a concavity which is formed between each blade, there is no need for a water level to totally cover a textile clothes load, because it will be in constant motion due to the generation of a strong stream going from the bottom to the top, resulting in a homogeneity in cleansing with a much less amount of water.

That is why the infuser with an integral coupler of the present invention finds its application in an automatic washing machine for home use including a clutch system preferably of the float-type, which comprises a main body preferably with a bell shape and hollowed in its inner portion and opened on its upper portion, comprising an upper section or shoulder, a middle section and a lower section or rim. Said body includes integrally on its contour a plurality of blades being apart and equidistantly distributed from each other, preferably extending from the proximity of the shoulder and extending down to the rim so as to form a part of the same.

In order to close the main body by its upper portion, said body further comprises a seal, forming a dry chamber so as to receive a movable body of the float-type clutch system, a screw allowing to secure the infuser to a shaft of the transmission system of said washing machine, and a cap located on the upper end of the movable body.

The infuser has an integral coupler located in the inner portion of the main body including on its inner face a plurality of U-shaped reinforcing elements; furthermore, the integral coupler includes a central body allowing to couple the infuser to the shaft of said transmission system, wherein said central body includes, internally, a plurality of grooves, as well as a plurality of reinforcing ribs to form chambers receiving the upper portion of the movable body or float of the floating clutch system.

As can be seen from the above, the integral coupler is structurally reinforced so as to support stresses due to the torque exerted by the transmission during the agitation or centrifugation in the interference region with the shaft.

Additionally, integral to its inner wall the infuser includes a second ring arranged underneath the central body, allowing to form a cavity to receive the movable body of the float-type clutch system and allowing for its vertical displacement, wherein said movable body has a double purpose, in the initial or resting position engages in a "centrifugal" mode; while in the floating position engages the infuser in the "agitation" mode, but said integral coupler contributes in both positions.

The infuser of the present invention is designed to be used in washing systems including a clutch system preferably of the float type, wherein the infuser set combined with the float-type clutch system allows providing a totally novel washing system with an infuser.

OBJECTS OF THE INVENTION

Considering the prior art drawbacks, it is an object of the present invention to provide an infuser with an integral coupler for use in automatic washing machines for home use, of a very simple construction and cost-effective, but highly efficient, practical and functional, so as to be used in machines preferably having floating clutch systems.

Another object of the present invention is to provide an infuser with an integral coupler to be used in automatic washing machines, manufactured in one piece so as to ensure a high resistance to stresses without the use of inserts or additional parts.

An additional object of the present invention is to provide an infuser including an integral coupler, which allows effectively assembling the movable body of the float-type clutch system.

Still another object of the present invention is to provide an infuser with an integral coupler for use in automatic washing machines, wherein thanks to its design and ergonomics allows for correctly transmitting the necessary power for better operation of said washing machine.

Still further, another object of the present invention is to provide an infuser with an integral coupler for use in automatic washing machines allowing to reduce manufacturing costs, because when the coupler is integrally included the manufacturing time for parts is reduced as well as the assembling time.

Still another object of the present invention is to provide an infuser with an integral coupler, which due to its specially designed outer geometry performs well during the agitation of clothes in a washing cycle, also integrally comprising in its lower portion a structurally reinforced body in order to resist stresses due to the torque exerted by the transmission during the agitation or centrifugation in the interference zone with the shaft transmitting the rotary motion.

BRIEF DESCRIPTION OF THE FIGURES

The novel aspects that are considered a characteristic of the present invention are particularly set forth in the appended claims. The invention itself, however, both as to its construction and its method of operation, together with additional objects and advantages thereof, will be best understood from the following detailed description of a particularly preferred embodiment when read and understood in connection with the accompanying drawing, wherein:

DETAILED DESCRIPTION OF THE EMBODIMENTS OF THE INVENTION

As discussed above in the Background of the Invention part, there is a great variety of washing machines, which include different types of washing systems, as well as different types of clutches. However, all of them has disadvantages regarding to a high consumption of water, or, a premature deterioration of textile clothes when friction occurs between them so as to remove dirt particles. Also, it was set forth that the friendliest washing system for textile clothes is the washing system using an infuser.

Therefore a infuser (100) having an integral coupler applicable to an automatic washing machine (not shown in the figures) for home use has been developed including a clutch system preferably of the float-type, which is described in a particularly preferred embodiment of the present invention and is shown in FIGS. 1 to 6 of the accompanying drawings, wherein said infuser (100) has both an outer and inner structural geometry, which ensure the axial motion of clothes in the washing cycles, as well as a perfect assembling to the movable body of the float-type clutch, respectively.

Figure 1:
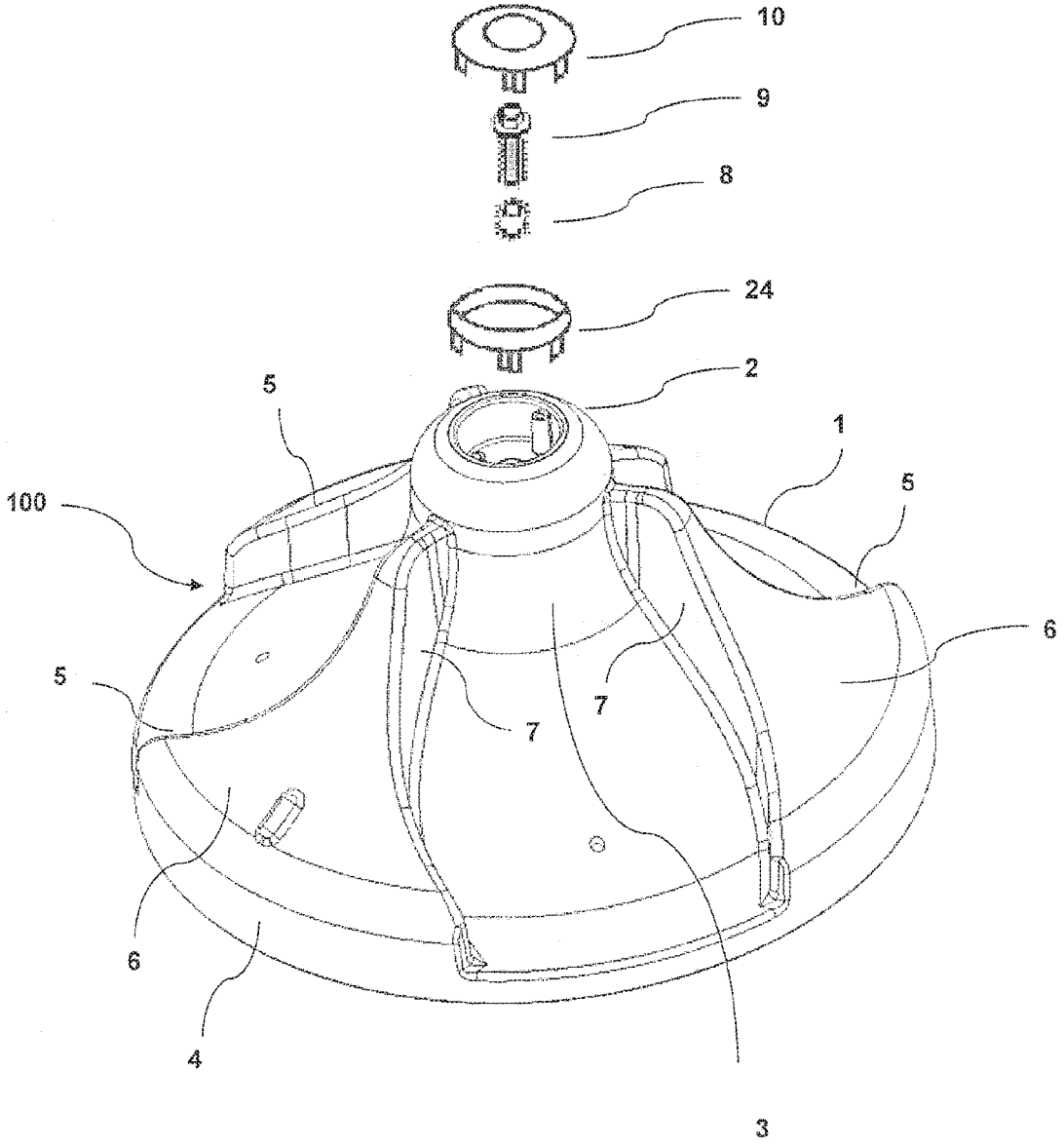
FIG. 1 is a front and upper perspective view of the infuser with an integral coupler, constructed according to the principles of a particularly preferred embodiment of the present invention.
Figure 2:
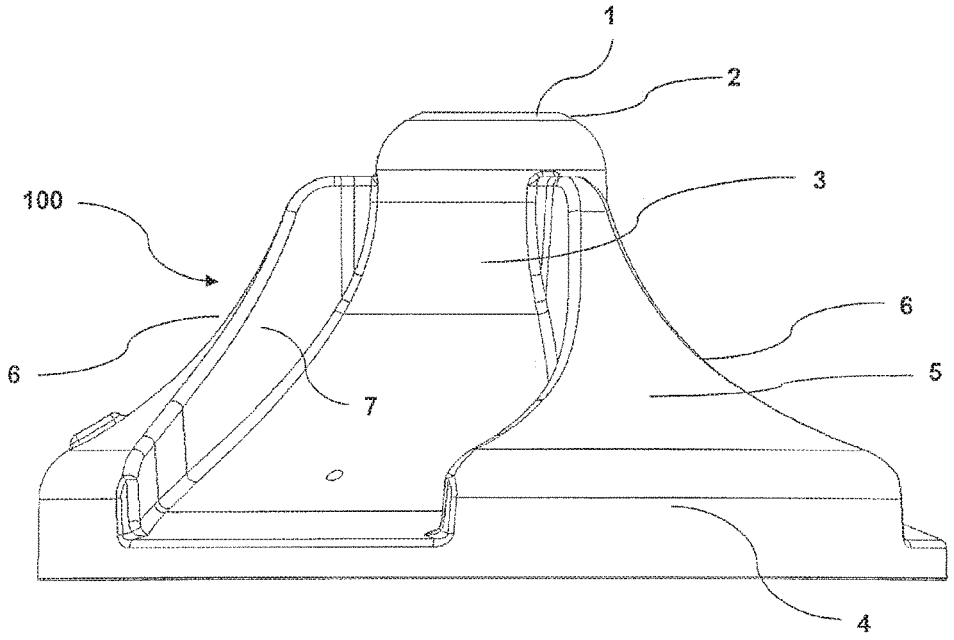
FIG. 2 is a side view of the infuser shown in FIG. 1.
Figure 3:
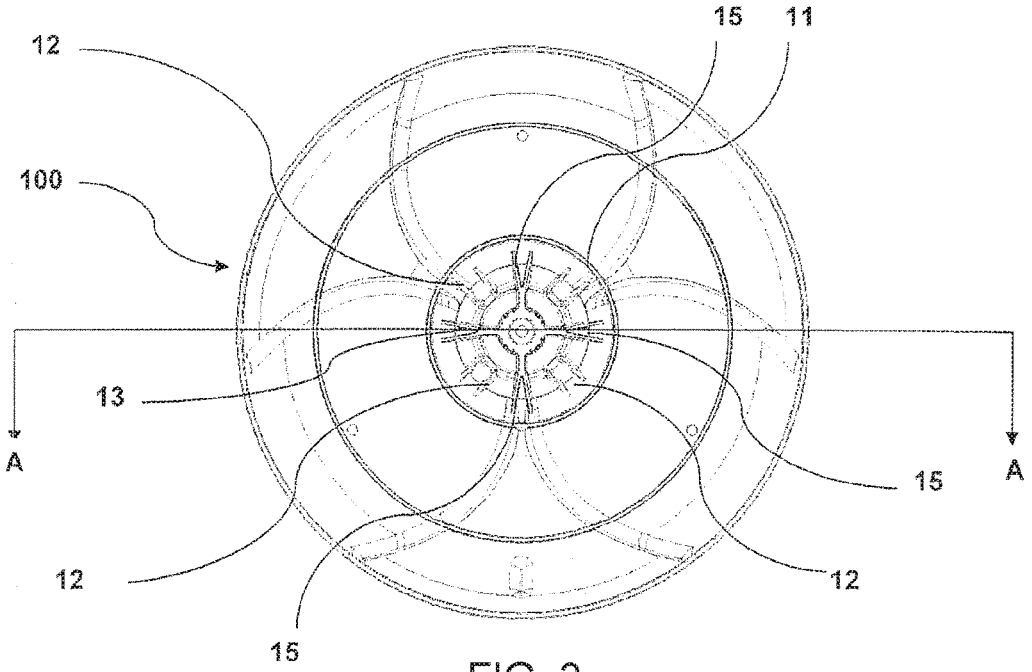
FIG. 3 is a plant view of the infuser shown in FIG. 1.
Figure 4:
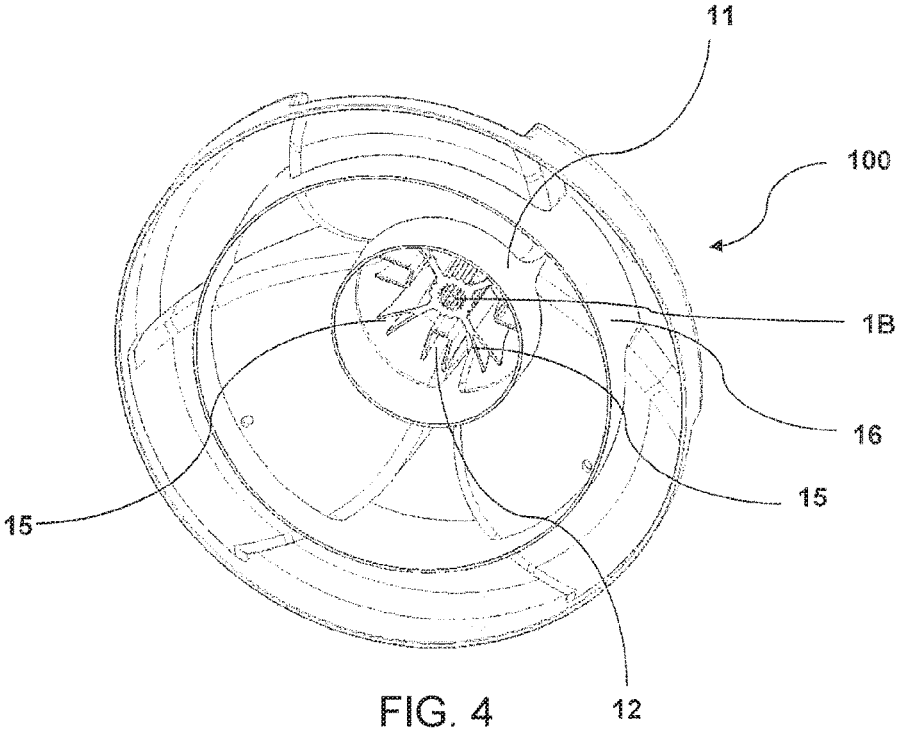
FIG. 4 is a lower perspective view of the infuser shown in FIG. 3.
Figure 5:
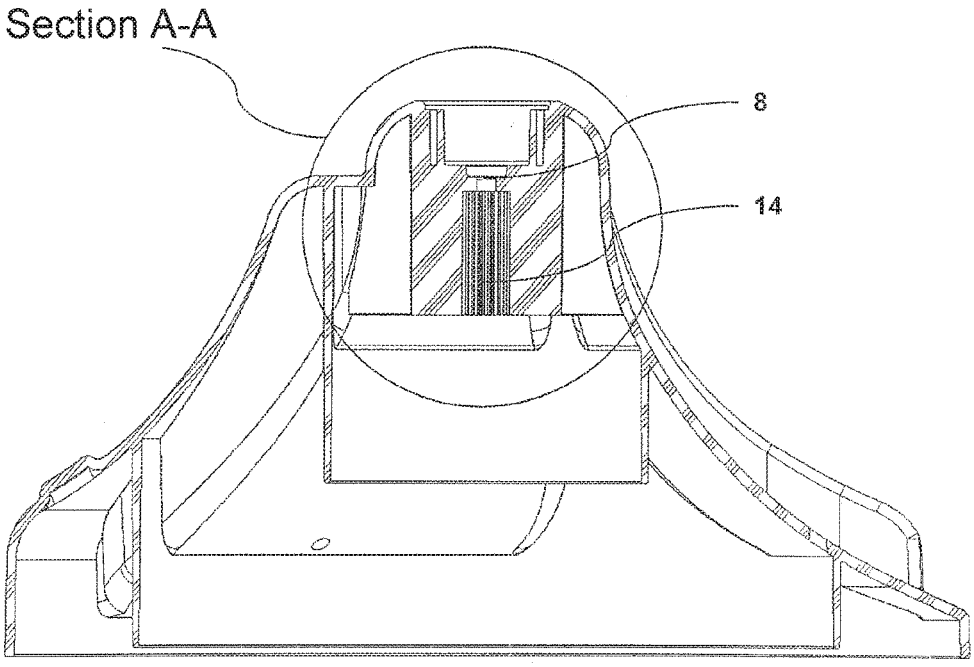
FIG. 5 is a cross-sectional view along line A-A of FIG. 2.
Figure 6:
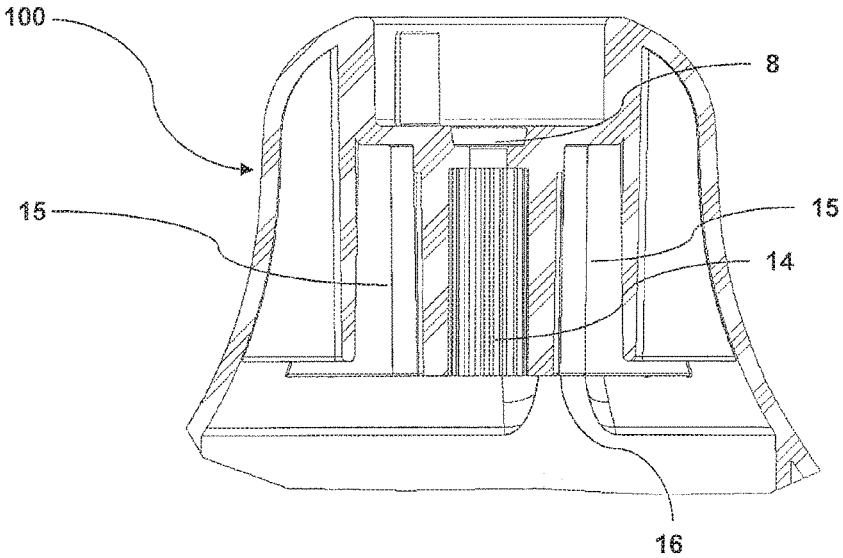
FIG. 6 is an enlarged view of the encircled section of FIG. 5.

The infuser (100) with an integral coupler of the present invention generally comprises: a main body (1) having preferably a bell shape and being hollow in its inner portion and opened on its upper portion, comprising an upper section or shoulder (2), a middle section (3) and a lower section or rim (4). Said body (1) integrally includes on its entire contour a plurality of blades (5), wherein said plurality comprise three blades (5) which are spaced apart and equidistantly distributed from each other, preferably extending from the proximity of the shoulder (2) and extending down to the rim (4) so as to form a part of the same, as can be seen in FIGS. 1 and 2 of the accompanying drawings.

Each of said blades (5) has on its front face (6) a curvature and on its side faces (7) a concavity, such that the space formed between each of said blades (5) in combination with the curvature of its frontal faces (6) generates a water stream in an axial manner which is strong enough to create a flow in the load going from the bottom to the top, where said flow allows the textile clothes load to be washed more efficiently with a much less amount of water.

As already mentioned several times in the foregoing, thanks to the outer geometry of the infuser (100), that is to say, to the combination of the curvature of the blades (5) on its front face (6) and the concavity on its side faces (7), there is no need for the water to completely cover the textile clothes load, because it is in constant motion due to the generation of a strong stream going from the bottom to the top, resulting in homogeneity in cleansing with a much less amount of water. In addition to the above, and unlike the other washing systems found in the state of the art, the washing cycle is not based on the friction of the clothes, because, as already mentioned above, the infuser (100) as described in the particularly preferred embodiment of the present invention provides the necessary force to generate the stream where the load moves from the bottom to the top and is in constant motion without requiring the scrubbing or direct contact with the infuser (100), thus achieving more care, and at the same time, less deterioration of the textile clothes.

In order to close the main body (1) on its upper portion, said body (1) further comprises a seal (8), allowing to form a dry chamber so as to receive a movable body (210) or float of the float-type clutch system, a screw (9) allowing to secure the infuser (100) to a shaft (220) of the transmission system of the washing machine, a cap (10) located on the upper end of the movable body and a crown (24) clamped or fixed to said cap (10).

It has already been said that both the outer and inner structural geometry, are some of the novel technical features of the infuser (100) of the present invention. Now, reference to said inner geometry will be made based on FIGS. 3 to 6 of the accompanying drawings, which show lower views of said infuser (100), as well as a cross-sectional view, including an integral coupler (11) located in the internal portion of the main body (1) and is in the form of a ring comprising on its inner face a plurality of U-shaped reinforcing elements (12), which are spaced apart and equidistantly distributed from each other, wherein said plurality is preferably comprised of four reinforcing members (12) spaced apart and arranged at 90° from each other; additionally, the coupler includes a central body (13) allowing to couple the infuser (100) to the shaft (220) of the transmission system, wherein said central body includes therein a plurality of grooves (14), as well as a plurality of reinforcing ribs (15), spaced apart and equidistantly distributed from each other, wherein said plurality is preferably comprised of four reinforcing ribs (14) spaced apart and arranged at 90° from each other, and the spacing between each of said reinforcing ribs (14) allows to form chambers (16) to receive the upper portion of the movable body (210) or float of the float-type clutch system.

As can be seen from the above, the integral coupler (11) is structurally reinforced so as to support stresses due to the torque exerted by the transmission during the agitation or centrifugation in the interference zone with the shaft (220).

Additionally, integral to its inner wall the infuser (100) includes a second ring (15) arranged underneath the central body (13), allowing to form a cavity to receive the movable body (210) of the float-type clutch system and allowing for its vertical displacement, wherein said movable body (210) has a double purpose, in the initial or resting position engages in a "centrifugal" mode; while in the floating position engages the infuser (100) in the "agitation" mode, but said integral coupler (11) of the infuser (100) contributes in both positions.

Figure 7:
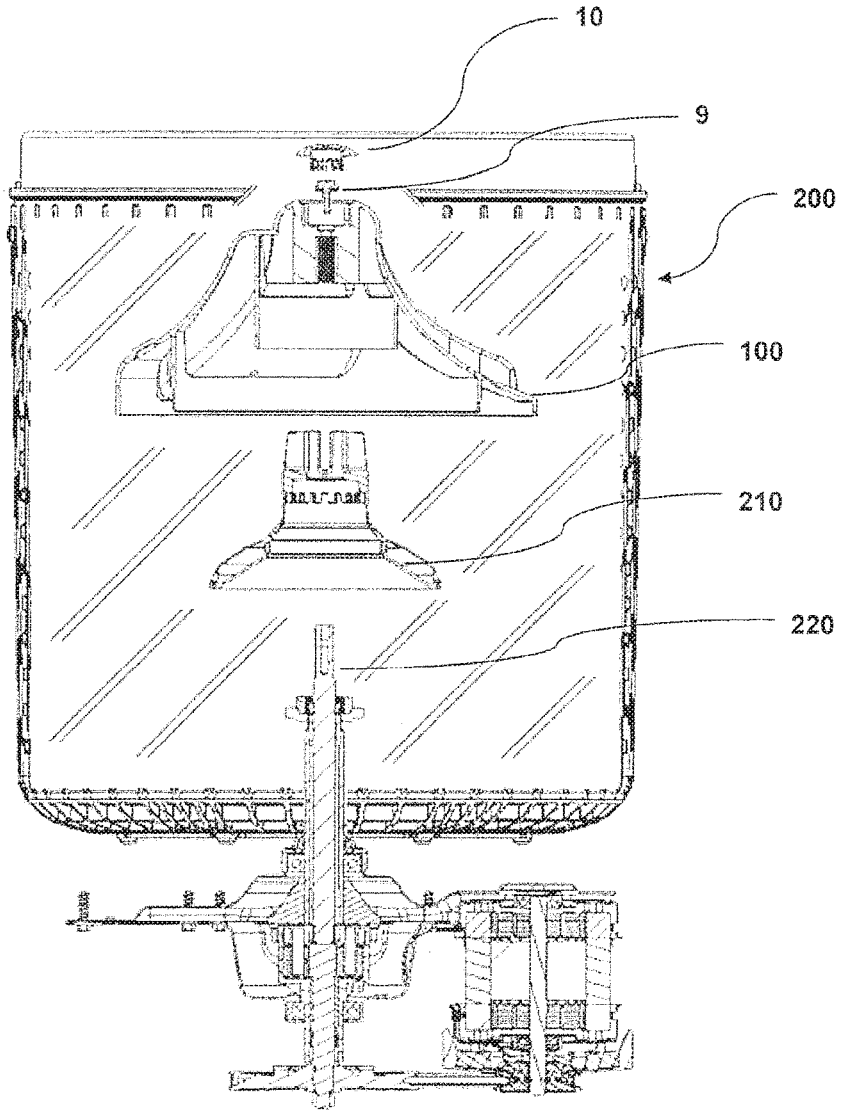
FIG. 7 is a side exploded schematic view showing both the infuser of the particularly preferred embodiment and the components of the float-type clutch, which in conjunction embodies the novel part of the present invention.

As already mentioned above, the infuser (100) of the present invention and as described in the particularly preferred embodiment, is designed to be used in washing systems including a clutch system preferably of the float-type, as can be seen in FIG. 7 of the accompanying drawings, wherein the set (200) of the infuser (100) combined with the float-type clutch system provides a totally novel washing system with an infuser.

A stress analysis on the interaction zone of the infuser (100) of the present invention with the movable body (220) of the float-type clutch system was carried out, and the results are shown in Table I:

TABLE I

| | Components | Stresses: Agitation (psi) | Stresses: Centrifugation (psi) | Material | Yield Strength (psi) | F.S. |
|---|---|---|---|---|---|---|
| Baseline | Agitator Ens. | 1056** | | Formosa | 4800 | 4.5 |
| | Agitator coupler | 428 | 111 | Formosa | 13000 | 30 |
| | Infuser | 293 | | Formosa | 4800 | 16 |
| New Concepts | Infuser | 494 | 123 | Braskem | 5511 | 11 |

Based on the obtained FEA results and comparing them with the baseline, it was concluded that the infuser is reliable in terms of stress.

While the foregoing description has made reference to some embodiments of the infuser with an integral coupler of the present invention, emphasis should be made to a number of possible modifications to said embodiments, without departing from the true scope of the invention, such as modification of the reinforcing ribs disposition, the outer and inner geometry of the blades, among many other modifications. Therefore, the present invention should not be limited except by what is established in the state of the art as well as by the appended claims

The invention claimed is:

1. An infuser for use in an automatic washing machine, comprising:

a hollow main body with an integral coupler that interact with a floating clutch, the said hollow main body comprising a shoulder (2), middle section (3) and a rim (4), the middle section extending upwardly from the rim (4) up to the shoulder (2) forming a bell shape, and opened on its shoulder (2), the hollow main body comprises the external phase;

wherein the shoulder is closable by a cap (10) and a seal (8) to close the open shoulder of the main body to form a dry chamber where a screw secures the infuser to a shaft of the transmission system of the washing machine;

wherein the integral coupler (11) is integrally formed and located in the inner portion of the hollow main body comprising a first ring extending downwardly from the shoulder, defining a skirt, defining a first dry sealed chamber in communication with the dry chamber of the infuser shoulder for reception of the upper section or head of the movable body of a float-type clutch system;

wherein the integral coupler comprises a central body (13), with a plurality of U-shaped reinforcing elements located on the inner face of the integral coupler where a central body (13) is integrated to the integral coupler, Wherein the central body allows coupling the infuser to the shaft of the transmission system through a plurality of reinforcing ribs integrated to the integral coupler, wherein the spacing between each of said reinforcing ribs forms chambers to receive the upper portion of the movable body or float of the floating clutch, the reinforcing ribs and the U-shaped reinforcing elements configured to resist and transmit the torque from the shaft of the transmission system;

wherein the integral coupler comprises a second ring integrated to the inner portion of the main body, extending downwardly forming a second skirt, arranged underneath the central body, and spaced apart from the first ring, forming a second sealable and dry cavity to receive the main part of the movable body of the floating clutch system while the upper portion is inserted in the first chamber and allowing its vertical displacement; and a plurality of integral radially extending blades (5) located on the entire contour of the hollow main body integrally formed with the main body;

wherein each blade (5) extends upward from the outer peripheral edge of rim (4) along the middle section up to the shoulder (2), and extends radially from the edge of the rim (4) and along the middle section up to the shoulder (2);

wherein each blade (5) comprises a triangular shape with a first peripheral face adjacent to the peripheral edge of the rim (4) and two side faces (7) extending from the rim (4), the middle section up to the shoulder (2) forming a closed wall all the way and defining an apex in close proximity to the shoulder and a curved front face (6);

wherein each blade (5) comprises a circumferential dimension at the first peripheral face greater than a second, reduced, circumferential dimension closer to the shoulder (2) at the apex;

wherein each blade (5) comprises a radial dimension at the peripheral face smaller than a second greater, radial dimension closer to the shoulder (2) at the apex, the radial dimension being substantially constant along the middle section;

wherein each blade (5) comprises a concave cavity in each side face (7) which extends from the peripheral edge of the rim (4) up to the shoulder (2) forming a channel of water between opposite side faces (7) of two adjacent blades (5), which extends from the edge of the rim (4) to the shoulder (2) to produce in combination with the curved front face (6), a water stream in an axial manner to create a flow in the load going from the rim (4) to the shoulder (2); and wherein the shoulder is closable by a cap (10) and a seal (8) to close the open shoulder of the main body to form a dry chamber where a screw secures the infuser to a shaft of the transmission system of the washing machine.

2. The infuser for use in the automatic washing machine of claim 1, wherein the plurality of blades is comprised of three blades, spaced apart and equidistantly distributed from each other, preferably extending from the proximity of the shoulder and extending down to the rim so as to form a part of the same.

3. The infuser for use in the automatic washing machine of claim 1, wherein the plurality of U-shaped reinforcing elements is comprised of four reinforcing elements, spaced apart and arranged 90° from each other.

4. The infuser for use in the automatic washing machine of claim 1, wherein the central body comprises internally, a plurality of grooves.

5. The infuser for use in the automatic washing machine of claim 1 where the plurality of reinforcing ribs is comprised of four reinforcing ribs, spaced apart and arranged 90" from each other.

* * * * *